US008215736B2

(12) United States Patent
Jorba et al.

(10) Patent No.: US 8,215,736 B2
(45) Date of Patent: Jul. 10, 2012

(54) PRINTHEAD DIAGNOSTIC PLOT

(75) Inventors: Joan Jorba, Barcelona (ES); Alex Andrea, Barcelona (ES); Angel Martinez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 431 days.

(21) Appl. No.: 12/526,549

(22) PCT Filed: Feb. 27, 2007

(86) PCT No.: PCT/EP2007/051860

§ 371 (c)(1), (2), (4) Date: Aug. 10, 2009

(87) PCT Pub. No.: WO2008/104222

PCT Pub. Date: Sep. 4, 2008

(65) Prior Publication Data

US 2010/0026744 A1 Feb. 4, 2010

(51) Int. Cl.

| | |
|---|---|
| ***B41J 29/38*** | (2006.01) |
| ***B41J 29/393*** | (2006.01) |
| ***B41J 2/015*** | (2006.01) |

(52) U.S. Cl. ..... 347/9; 347/14; 347/19; 347/20

(58) Field of Classification Search ..... 347/9, 14, 347/19–20

See application file for complete search history.

(56) References Cited

U.S. PATENT DOCUMENTS

2005/0284330 A1 * 12/2005 Jackson ..... 106/31.6
2007/0064037 A1 * 3/2007 Hawkins et al. ..... 347/19

FOREIGN PATENT DOCUMENTS

JP 09066650 A * 3/1997

* cited by examiner

*Primary Examiner* — Jason Uhlenhake

(57) ABSTRACT

Among various embodiments of the present disclosure, systems and methods for diagnosing printhead status are shown. The printhead status can be diagnosed by detecting which of a number of nozzles in a first printhead fire ink; and printing with visible ink a diagnostic plot using a second printhead that maps which nozzles fire ink in the first printhead. The number of nozzles in the first printhead which fire ink is determined by visually identifying the nozzles that fire ink in the second printhead as indicated by the placement of the visible ink on the diagnostic plot.

20 Claims, 7 Drawing Sheets

PRINTHEAD DIAGNOSTIC PLOT

INTRODUCTION

Printing devices (e.g., inkjet printers, laser printers, and the like) can operate according to control signals, commands, and/or computer readable instruction sets to effectuate the transfer of ink onto print media. In an inkjet printer, one or more controllers (e.g., microprocessors) can regulate the movement of a carriage that can move a number of inkjet pens or printheads, across a print media. The controllers can further regulate the timing and/or firing of the ink onto the print media. In an inkjet printer, ink can be ejected onto the print media from one or more inkjet printheads, each inkjet printhead containing one or more nozzles through which the ink is ejected. The image quality of the printer can be a major concern for users, especially with the use of digital photography and the printing of digital images on printing devices.

Gloss uniformity is an image quality attribute for digital photography professionals. Gloss enhancer is a transparent ink used to improve gloss uniformity. Gloss enhancer can be used in various types of printers, including professional photographic printers. A diagnostic plot may currently be used with printers to allow users to check nozzle firing status of the transparent ink printheads. However, because gloss enhancer ink is substantially transparent, it is not easy for a user to assess whether a nozzle is firing.

A diagnostic plot that may be used for checking nozzle firing status of the gloss enhancer printhead can print the gloss enhancer on a gray patch. The gloss enhancer can be visible, if only minimally, on the gray patch which can make it possible to visualize the nozzle firing status of the gloss enhancer printhead. In the case that the grey printhead has some nozzle health problems and can not properly print a gray patch on a print medium, the gray area fill will show white areas and it will be impossible to assess the nozzle status of the gloss enhancer printhead.

DETAILED DESCRIPTION

Figure 1:
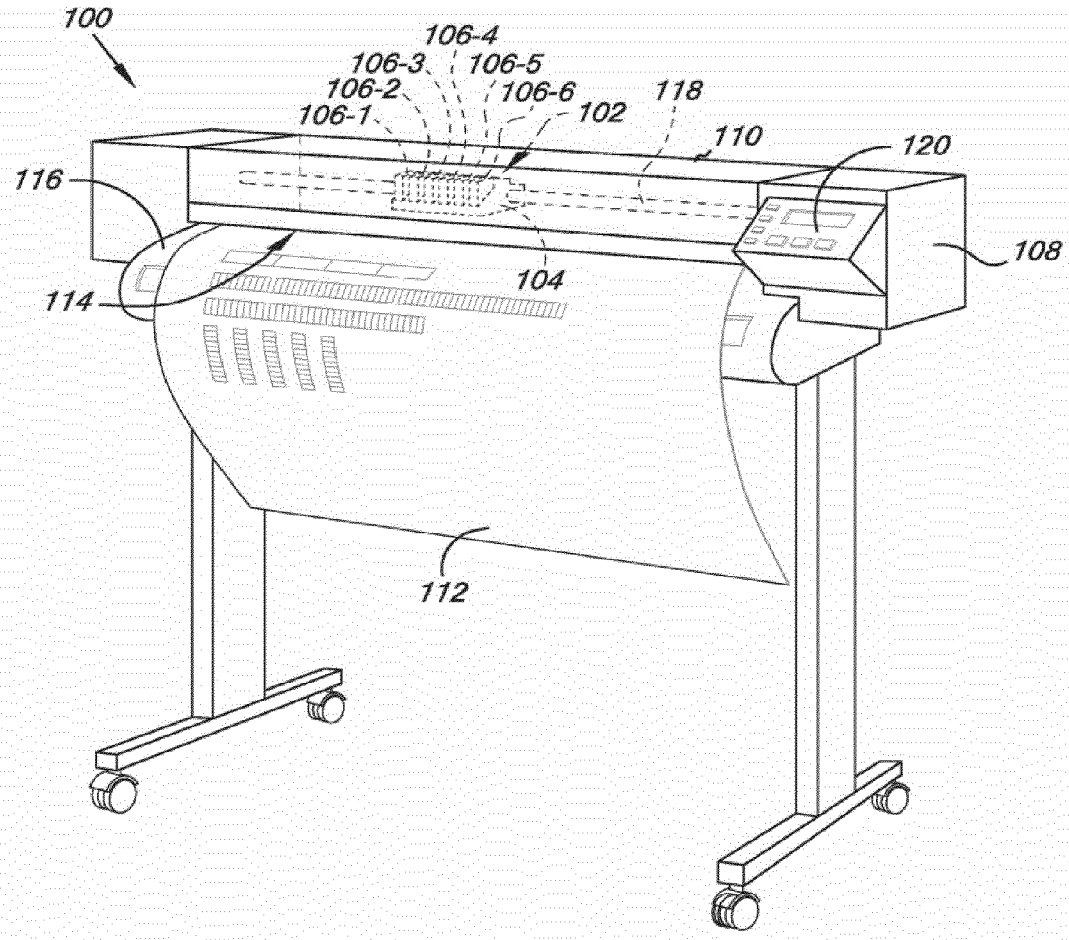
FIG. 1 illustrates an example printing apparatus suitable to implement embodiments of the present disclosure.

Embodiments of the disclosure herein provide systems and methods for a printhead diagnostic plot. A nozzle firing diagnostic plot for the transparent gloss enhancer ink is disclosed, which can also be used for low visibility ink, such as yellow ink. An embodiment of a method for diagnosing printhead status includes diagnosing which of a number of nozzles fire ink in a first printhead using a drop detector and printing a diagnostic plot using a second printhead that maps the nozzles firing ink from the first printhead. In various embodiments, an electrostatic or optical sensor detects the nozzles that fire ink in the first printhead. The ink in the first printhead can be gloss enhancer or a low visibility ink and the ink in the second printhead can be a visible ink. In various embodiments, the printhead diagnosis occurs by visually identifying the nozzles that are firing ink as indicated by the visible ink on the diagnostic plot.

Mid-range and high-end printers can have a built-in device called a drop detector. This device can be an electrostatic sensor, an optical sensor, or other various drop detectors that allows detection of the ink drops fired by any printhead. This means that it is possible to know the nozzle status of the printheads with a transparent ink, like gloss enhancer. Once the nozzle status of the gloss enhancer is known by the drop detector, a nozzle health pattern can be printed with a visible ink printhead. This printhead will print by disabling the same nozzles that failed to print in the gloss enhancer printhead. It is evident that the visible ink printhead should have good nozzle health to correctly reproduce the nozzle status of the gloss enhancer. Since a standard printer has 12 colors in 6 pens, the probability of having a printhead with good nozzle health is high.

In one embodiment, a printhead diagnostic plot system consists of a first printhead with a number of nozzles, a number of drop detectors that determine which nozzles in the first printhead eject ink, and a second printhead with a number of nozzles. In various embodiments of a printhead diagnostic plot system, the first printhead, the drop detectors, and the second print are coupled together to allow the second printhead to print a diagnostic plot with visible ink that maps the nozzles that fired ink in the first printhead as detected by the drop detector. In various embodiments, a nozzle on the second printhead is enabled when the corresponding nozzle on the first printhead fires ink and a nozzle on the second printhead is disabled when the corresponding nozzle on the first printhead does not fire ink. A diagnostic plot is printed by the second printhead using only enabled nozzles. A visual inspection of the diagnostic plot is then completed to determine the nozzle status of the first printhead.

This diagnostic plot allows for a determination of nozzle health of the gloss enhancer printhead that can be assessed by a user. In using this diagnostic plot, diagnosis of whether an image quality defect is or is not caused by nozzle health problems in the gloss enhancer printhead can be completed by a visual inspection. Moreover, the nozzle health diagnostic plot presented is not only applicable to the gloss enhancer printhead, but also to any printhead containing a low visibility ink, such as yellow.

FIG. 1 illustrates an example printing apparatus suitable to implement embodiments of the present disclosure. FIG. 1 provides a perspective illustration of an embodiment of a printing device, or printer, which is operable to implement or which can include embodiments of the present invention. The embodiment of FIG. 1 illustrates an inkjet printer 100, which can be used for high performance graphics printing. However, the embodiments of the invention are not so limited and can include other printers implementing various embodiments of the present invention. In the embodiment of FIG. 1, the printer 100 includes a printhead unit 102 which moves back and forth through the print zone. A feed mechanism for the media (not shown) can comprise conventional friction rollers, e.g., main drive roller, pinch wheels and/or overdrive wheels, that may be used to feed the print media 112 through the printing mechanism, along a feed path of the same and out of the printer through an opening 114 defined between the lower edge of a cover 110 and a front platen 116.

The printer 100 has a predefined print zone which coincides, at least partly, with the feed path of the media in such a way that the latter is fed through the printing zone. An illustrative printing zone is defined as an area within which each of the multiple nozzles of the printheads of the printhead unit 102 may print throughout the entire width of the media.

The printhead unit 102 that moves back and forth includes a carriage 104 mounted in such a way that it may slide on at least one fixed guide rod 118 so as to move bi-directionally along the platen. In the embodiment of FIG. 1, the carriage 104 is designed to traverse the width of the platen, thus completely crossing the printing zone. The unit 102 includes a driving sub-unit (not shown) which is connected mechanically to pull the carriage 104 in one direction or another along the guide rod 118. The embodiments of the invention are not so limited and can include other printhead units 102 with other carriage 104 configurations implementing various embodiments of the present invention.

In the embodiment of FIG. 1, the ink printheads are transported by a carriage 104. The carriage 104 can be driven along a guide rod 118 by a drive belt/pulley and motor arrangement (not shown). The actual motor control arrangement can vary among printing devices. The carriage 104 herein supports and carries one or more print cartridges or printheads. In the embodiment of FIG. 1, six printheads, 106-1, 106-2, 106-3, 106-4, 106-5, and 106-6 are in the carriage 104. The printheads 106-1 to 106-6 are mounted on the carriage 104 in such a way that their nozzle sections are adjacent to a supporting platen, but separated from it, so as to allow the media to pass between them. The carriage 104 moves the printheads in one direction or another through the print zone along the scanning axis. In the embodiment illustrated, the carriage 104 carries printheads that carry various inks, including gloss enhancer.

In the embodiment of FIG. 1, the printhead cartridges 106-1, 106-2, 106-3, 106-4, 106-5, 106-6, selectively deposit ink droplets on a sheet of paper or other print media in accordance with instructions received via a printer controller 120 which can be located within chassis 108. The controller, shown in FIGS. 2A and 2B, operates on a set of executable instructions to perform tasks associated with the printer 100.

Figure 2A:
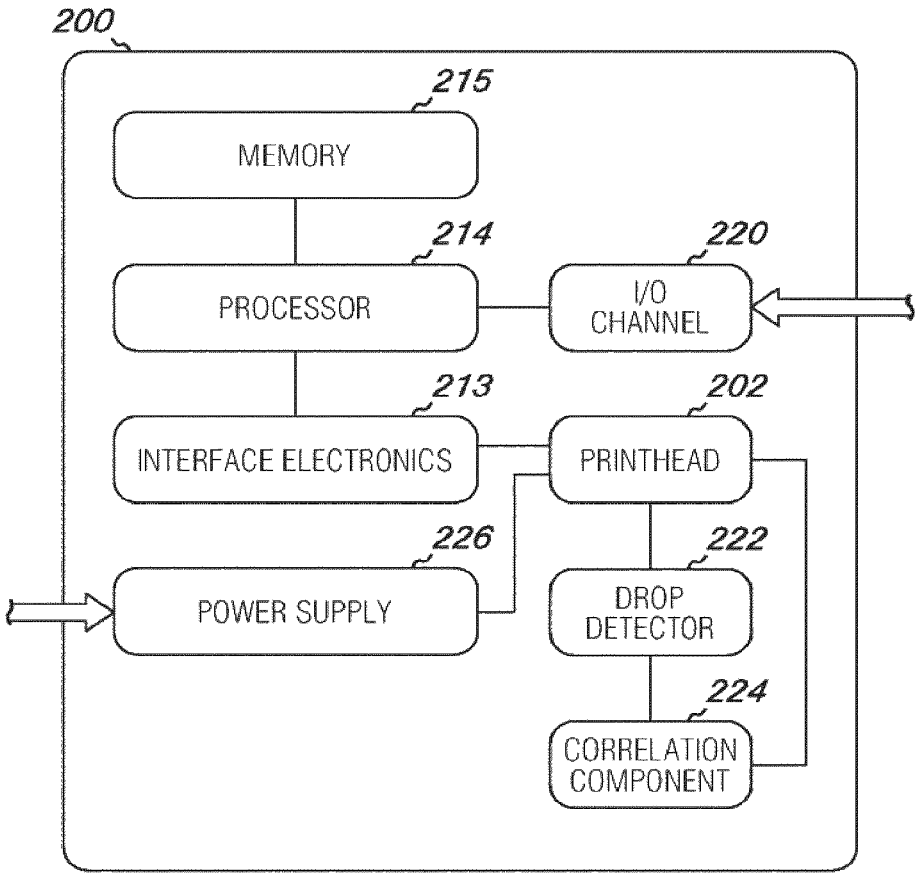
FIG. 2A illustrates an embodiment of electronic components includable in an apparatus, such as the printing apparatus of FIG. 1.
Figure 2B:
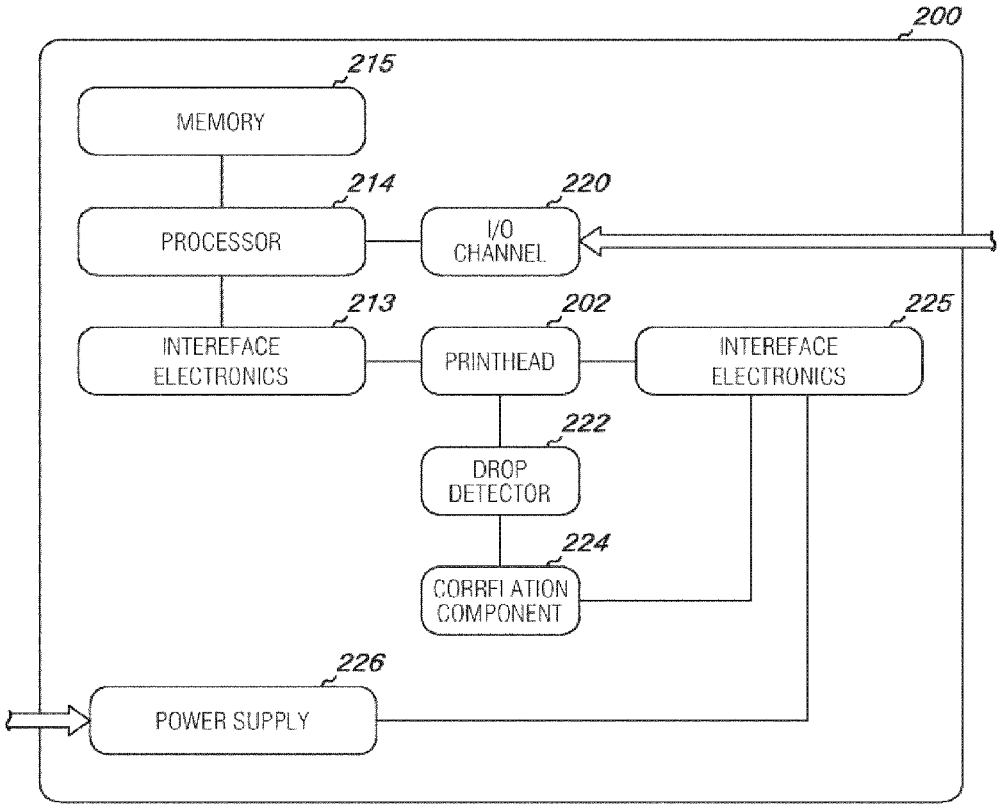
FIG. 2B illustrates another embodiment of electronic components includable in an apparatus, such as the printing apparatus of FIG. 1.

FIGS. 2A and 2B illustrate an embodiment of electronic components includable in an apparatus, such as the printing apparatus of FIG. 1. As shown in the embodiments of FIGS. 2A and 2B, an inkjet printer 200 includes a printhead 202. Each printhead has multiple nozzles (shown in FIG. 3). Printer 200 includes control logic in the form of executable instructions which can exist within a memory 215 and be operated on by a controller or processor 214. The controller 214 is operable to read and execute computer executable instructions received from memory 215. Interface electronics 213 are associated with printer 200 to interface between the control logic components and the electromechanical components of the printer such as the printhead 202. Interface electronics 213 include, for example, circuits for moving the printhead and paper, and for firing individual nozzles.

The executable instructions carry out various control steps and functions for the inkjet printer 200. Memory 215 can include some combination of ROM, dynamic RAM, and/or some type of nonvolatile and writeable memory such as battery-backed memory or flash memory.

The controller 214 can be interfaced, or connected, to receive instructions and data from a remote device (e.g. host computer), such as 710 shown in FIG. 7, through one or more I/O channels or ports 220. I/O channel 220 can include a parallel or serial communications port, and/or a wireless interface for receiving information, e.g. print job data.

A drop detector 222 is provided which is operable to determine if ink is ejected from a nozzle in a printhead. The drop detector 222 can be an electrostatic sensor, an optical sensor, or other various sensors on the printhead 202. The drop detector 222 can determine the functional status of the nozzles in a printhead while the printhead 202 is in use.

As shown in the embodiments of FIGS. 2A and 2B, the electronic components include a correlation component 224 coupled to the drop detector 222 and printhead 202. The correlation component 224 can include software and/or firmware operable to determine the nozzles that are functioning in a printhead 202, according to the execution of one or more sets of computer executable instructions.

In various embodiments, the correlation component 224 is able to analyze the output of the nozzle on a printhead 202, e.g., using the drop detector 222. Based on this analysis, the correlation component 224 can provide instruction for mapping a diagnostic plot to be printed with another visible ink printhead. For example, the drop detector 222 and correlation component 224 in FIG. 2A can use the information from the correlation components' analysis of the nozzle in printhead 202 using the drop detector 222 to map instructions for a diagnostic plot that can be printed with a visible ink printhead in a configuration such as shown in FIG. 2B.

Figure 3:
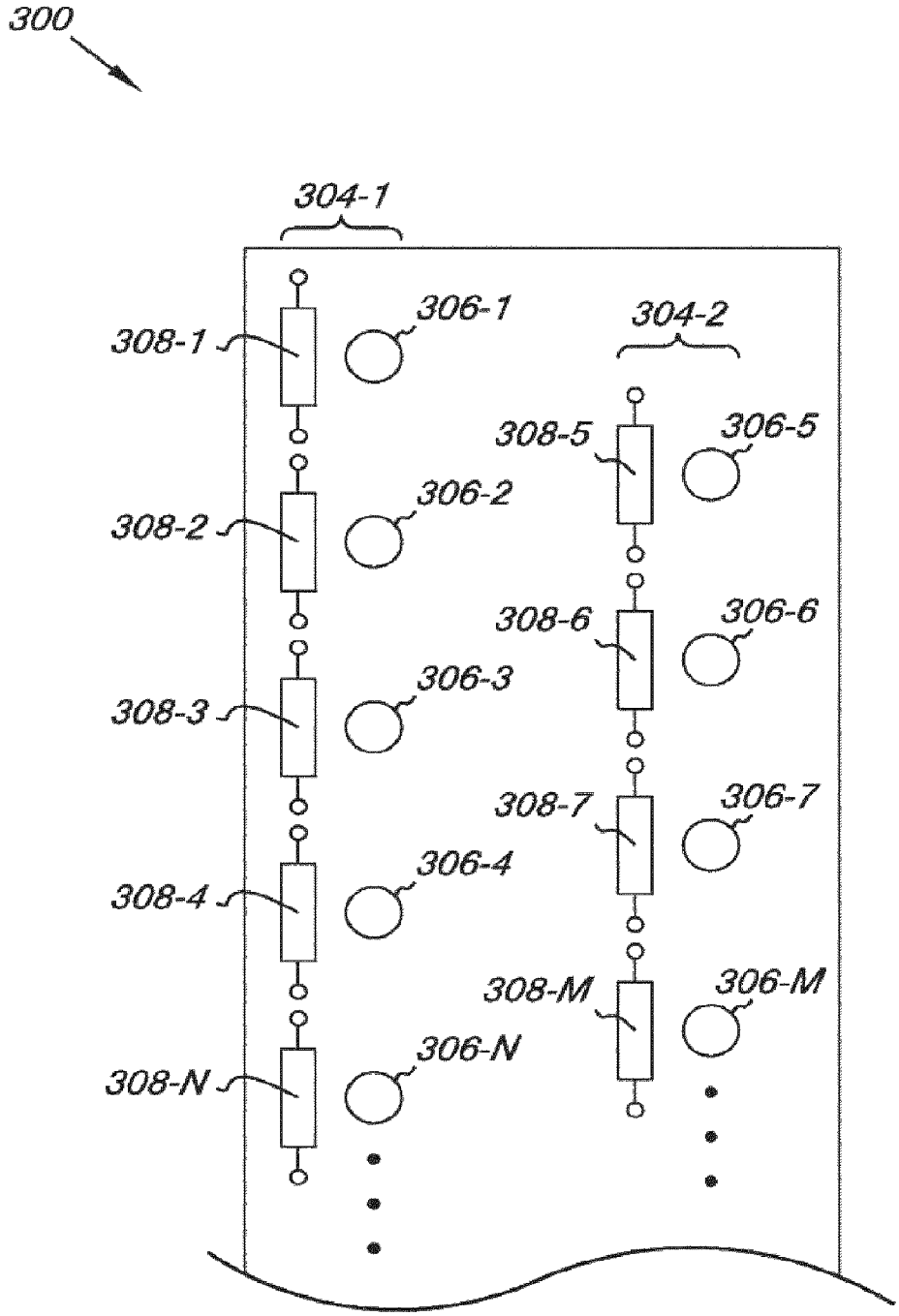
FIG. 3 illustrates a configuration of a printhead module array according to an embodiment of the present disclosure.

FIG. 3 illustrates a configuration of a printhead module array according to an embodiment of the present disclosure. The inkjet printhead 300 has laterally spaced nozzle columns 304-1 and 304-2. Each of the laterally spaced nozzle columns has nozzles 306-1 through 306-N and 306-5 through 306-M. Each of the nozzles 306-N, 306-M has a drop detector 308-N, 308-M. Each of the nozzles 306-N, 308-M can be located at a different position. Print media is advanced in a direction relative to the inkjet printhead 300. The inkjet printhead 300 is operable to be moved across the print media in swaths. The ejection of ink in each of the nozzles 306-N, 306-M is detected by the drop detectors 308-N, 308-M. This information is then transferred to a second printhead through the means described in FIGS. 2A and 2B, which will use this information to print a diagnostic plot of the functioning nozzles in the first printhead.

The example of the inkjet printhead 300 shown in FIG. 3 is provided for illustration, and there are many different printhead configurations possible. Implementation of the embodiments of the invention is not limited to any particular printhead configuration.

Figure 4:
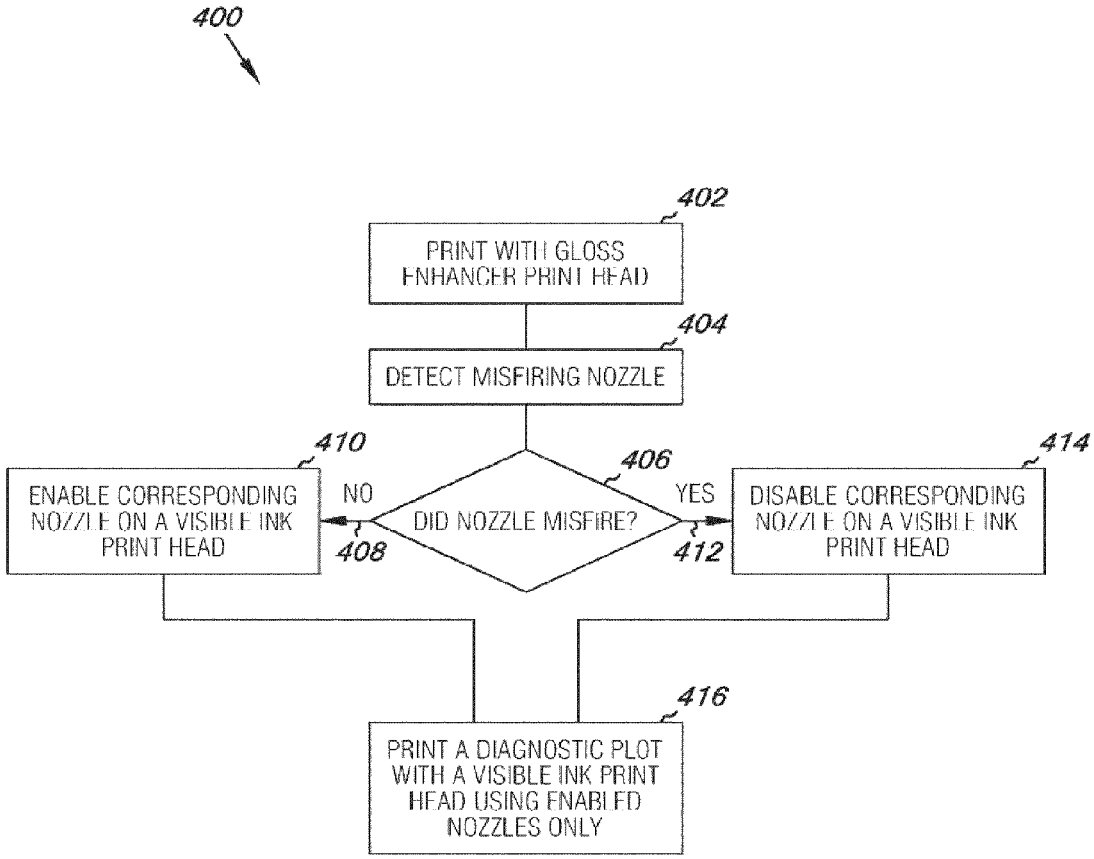
FIG. 4 is a block diagram illustrating using a drop detector to develop a diagnostic plot indicating the nozzle firing status of a printhead according to an embodiment of the present disclosure.

FIG. 4 is a block diagram illustrating using a drop detector to develop a diagnostic plot indicating the nozzle firing status of a printhead according to an embodiment of the present disclosure. FIG. 4 illustrates an algorithm 400 that develops a diagnostic plot indicating the nozzle status of a printhead. As illustrated in FIG. 4, an embodiment of an algorithm 400 can be used to determine which of the nozzles in a printhead are functioning. A number of print nozzles of a printing system can use a number of different inks, including gloss enhancer, for printing text and/or images on a print medium. In some embodiments, detection of misfiring nozzles can be performed by examining a diagnostic plot printed using a number of nozzles from a visible ink printhead.

In some embodiments, as shown in FIG. 4, after a gloss enhancer printhead as printed using all of the nozzles in the printhead 402, the algorithm 400 can be used to determine with a drop detector whether the nozzles in the gloss enhancer printhead are functioning 404. If the drop detector determines a given nozzle in the gloss enhancer printhead is functioning 408, e.g., did not misfire, the algorithm 400 can be used to enable a corresponding nozzle on a visible ink printhead 410. In some embodiments, if the drop detector determines a given nozzle in the gloss enhancer printhead is not functioning 412, e.g., misfired, the algorithm 400 can be used to disable a corresponding nozzle on a visible ink printhead 414. In some embodiments, the algorithm 400 can use the information of whether a nozzle misfired 406 and the enabling 410 or disabling 414 of the nozzles on a visible ink printhead to print a visible ink diagnostic plot 416. The printing of a diagnostic plot with a visible ink head 416 is done with the only the nozzles enabled that fired in the gloss enhancer printhead. The enabling 410 and disabling of the nozzles in the visible ink printhead is done so that the diagnostic plot made with the visible printhead maps the nozzles that fired in the gloss enhancer printhead, which allows for a visual representation of the nozzle functioning status of the gloss enhancer printhead.

Figure 5:
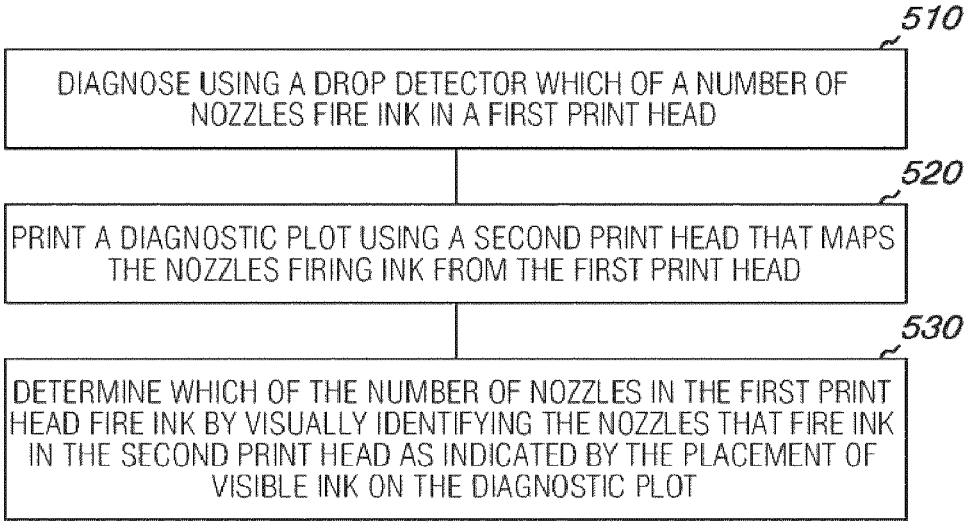
FIG. 5 is a block diagram illustrating using a diagnostic plot to determine the nozzle firing status of a printhead according to an embodiment of the present disclosure.

FIG. 5 is a block diagram illustrating using a diagnostic plot to determine the nozzle firing status of a printhead according to an embodiment of the present disclosure. FIG. 5 illustrates an algorithm that identifies the functionality of the nozzles in a printhead. As illustrated in FIG. 5, an embodiment of an algorithm 500 can be used to determine which of the nozzles in a printhead are functioning by a visual inspection of a diagnostic plot. In some embodiments, detection of misfiring nozzles can be performed by examining a diagnostic plot printed that used a number of print nozzles that use a visible ink printhead, which mapped the functioning nozzles of a gloss enhancer printhead.

In some embodiments, as shown in FIG. 5, a diagnostic plot is generated on a print medium using a visible ink printhead 502, which is completed by using the information from the algorithm 400 describe in FIG. 4. The algorithm 500 can be used to determine which nozzles the visible ink printhead did not print by a visual inspection of the diagnostic plot 504. This inspection is then used to make the determination of which nozzles are functioning in the gloss enhancer printhead. This determination of which nozzles did not print in the gloss enhancer printed head can be done by a visual inspection because the diagnostic plot uses a printhead that print visible ink that maps the functioning nozzles of the gloss enhancer printhead, as described in FIG. 4. The visual inspection of the diagnostic plot can determine which nozzles did not print in the gloss enhancer printhead by associating the nozzles of the visible printhead with the nozzles of the gloss enhancer printhead 506.

As such, in various embodiments, algorithm 500 can be used for image quality trouble shooting by determining where the gloss enhancer is not being applied to the print media that is being printed on by the printer. In some embodiments of the present disclosure, algorithm 500 can be used to show the nozzle status of the gloss enhancer printhead. This information can be used to implement various remedies for nozzles that are not functioning properly. The nozzles in the gloss enhancer printhead that are not functioning properly can physically be repaired or replaced once it is determined that they are the cause of the image quality problems the printer is experiencing. Also, the printer can remedy the image quality issues by implementing another algorithm that uses other functioning nozzles that compensate for the nonfunctioning nozzles through repositioning of the print media or delivery patterns of the gloss enhancer.

In some embodiments, a compensatory algorithm can be implemented using a processor to execute instructions to at least partially determine which of a number of print nozzles is a potential substitute by determining which of a number of inks utilized in the print nozzles can be used to substitute for the one or more misfiring print nozzles.

In various embodiments of the present disclosure, a printing system can at least partially compensate for one or more potentially misfiring print nozzles that are intended to eject gloss enhancer to defined locations on the print medium by using one or more print nozzles to deposit droplets of gloss enhancer at the defined locations that are intended to gloss enhancer. That is, in some embodiments, at least partially compensating for a potentially misfiring print nozzle can be performed in substantially all locations where gloss enhancer is intended to be deposited by using at least one other print nozzle to deposit gloss enhancer where the gloss enhancer is intended to be deposited by the misfiring nozzle.

Figure 6:
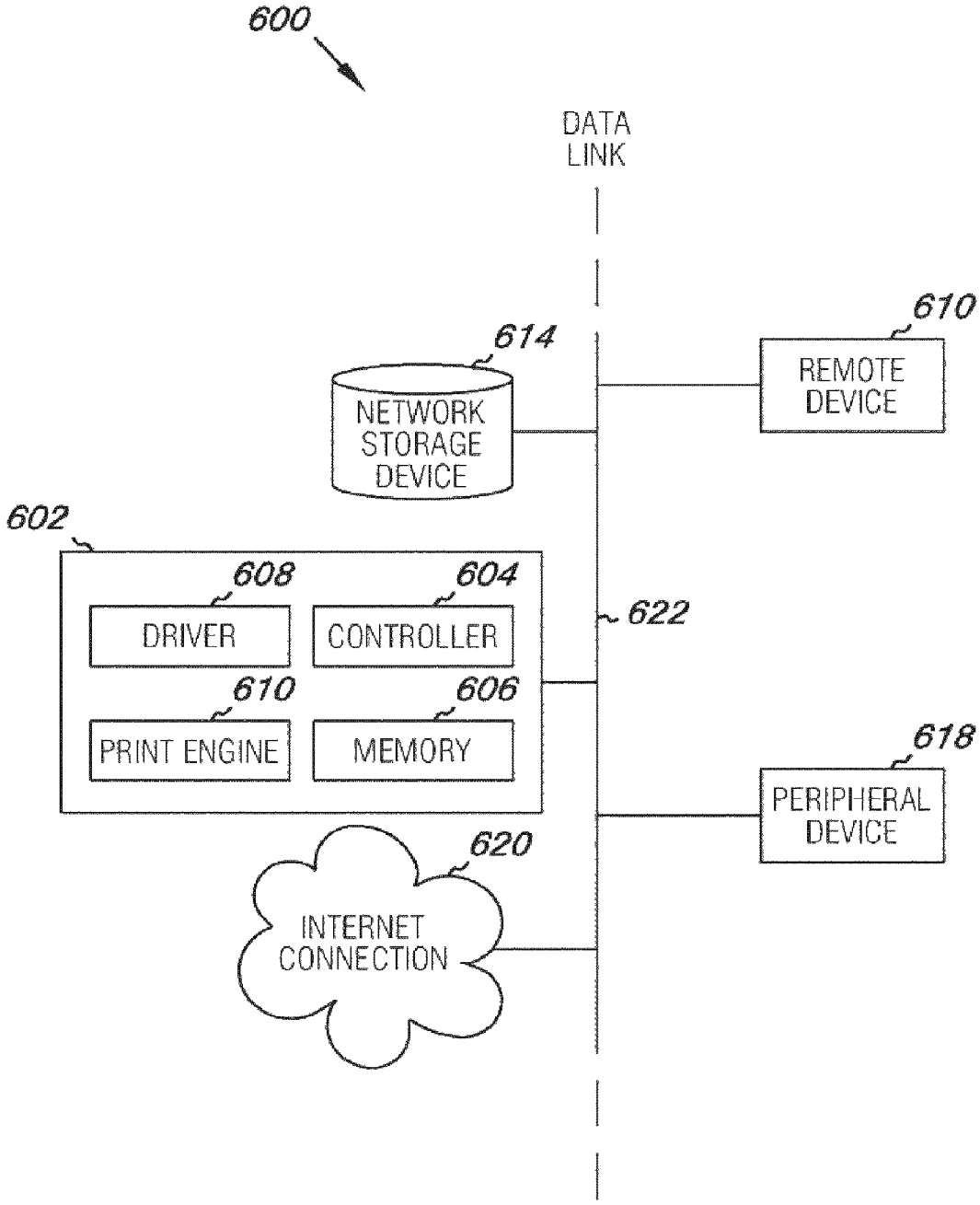
FIG. 6 illustrates a system suitable to implement embodiments of the present disclosure.

FIG. 6 illustrates a system suitable to implement embodiments of the present disclosure. FIG. 6 illustrates that a printing device, including embodiments described herein, can be incorporated as part of a system 600. As shown in FIG. 6, the system includes a printing device 602, such as an inkjet printer as described herein.

The system 600 is operable to receive data and interpret the data to position an image in a particular image position. The system 600 can include software and/or application modules thereon for receiving and interpreting data in order to achieve the positioning and/or formatting functions. As one of ordinary skill in the art will appreciate, the software and/or application modules can be located on any device that is directly or indirectly connected to the printing device 602 within the system 600.

The printing device 602 can include a controller 604 and a memory 606, such as the controller and memory discussed in connection with FIGS. 2A and 2B. The controller 604 and the one or more memory devices are operable to implement the method embodiments described herein. In the various embodiments, the one or more memory devices 606 include memory devices 606 on which data, including computer readable instructions, and other information of the like can reside.

In the embodiment shown in FIG. 6, the printing device 602 can include a printing device driver 608 and a print engine 610. In various embodiments of FIG. 6, additional printing device drivers can be located off the printing device, for example, on a remote device 612. Such printing device drivers can be an alternative to the printing device driver 608 located on the printing device 602 or provided in addition to the printing device driver 608. As one of ordinary skill in the art will understand, a printing device driver 608 is operable to create a computer readable instruction set for a print job utilized for rendering an image by the print engine 610. Printing device driver 608 includes any printing device driver suitable for carrying out various aspects of the embodiments of the present invention. That is, the printing device driver can take data from one or more software applications and transform the data into a print job.

When a printing device is to be utilized to print an image on a piece of print media, a print job can be created that provides instructions on how to print the image. These instructions are communicated in a Page Description Language (PDL) to initiate a print job. The PDL can include a list of printing properties for the print job. Printing properties include, by way of example and not by way of limitation, the size of the image to be printed, its positioning on the print media, resolution of a print image (e.g. DPI), color settings, simplex or duplex setting, indications to process image enhancing algorithms (e.g. halftoning), and the like.

As shown in the embodiment of FIG. 6, printing device 602 can be networked to one or more remote devices 610 over a number of data links, shown as 622. As one of ordinary skill in the art will appreciate upon reading this disclosure, the number of data links 622 can include one or more physical and one or more wireless connections, and any combination thereof, as part of a network. That is, the printing device 602 and the one or more remote devices 610 can be directly connected and can be connected as part of a wider network having a plurality of data links 622.

In various embodiments, a remote device 612 can include a device having a display such as a desktop computer, laptop computer, a workstation, hand held device, or other device as the same will be known and understood by one of ordinary skill in the art. The remote device 612 can also include one or more processors and/or application modules suitable for running software and can include one or more memory devices thereon.

As shown in the embodiment of FIG. 6, a system 600 can include one or more networked storage devices 614, e.g. remote storage database and the like, networked to the system. Likewise, the system 600 can include one or more peripheral devices 618, and one or more Internet connections 620, distributed within the network.

The network described herein can include any number of network types including, but not limited to a Local Area Network (LAN), a Wide Area Network (WAN), Personal Area Network (PAN), and the like. And, as stated above, data links 622 within such networks can include any combination of direct or indirect wired and/or wireless connections, including but not limited to electrical, optical, and RF connections.

Memory, such as memory 606 and memory 614, can be distributed anywhere throughout a networked system. Memory, as the same is used herein, can include any suitable memory for implementing the various embodiments of the invention. Thus, memory and memory devices include fixed memory and portable memory. Examples of memory types include Non-Volatile (NV) memory (e.g. Flash memory), RAM, ROM, magnetic media, and optically read media and includes such physical formats as memory cards, memory sticks, memory keys, CDs, DVDs, hard disks, and floppy disks, to name a few.

Software, e.g. computer readable instructions, can be stored on such memory mediums. Embodiments of the invention, however, are not limited to any particular type of memory medium. And, embodiments of the invention are not limited to where within a device or networked system a set of computer instructions is stored on memory for use in implementing the various embodiments of invention.

As noted, the system embodiment 600 of FIG. 6 can include one or more peripheral devices 618. Peripheral devices can include any number of peripheral devices in addition to those already mentioned herein. Examples of peripheral devices include, but are not limited to, scanning devices, faxing devices, copying devices, modern devices, and the like.

Although specific embodiments have been illustrated and described herein, those of ordinary skill in the art will appreciate that an arrangement calculated to achieve the same results can be substituted for the specific embodiments shown. This disclosure is intended to cover adaptations or variations of various embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for diagnosing printhead status, comprising:

diagnosing which of a number of nozzles fire ink in a first printhead using a drop detector; and printing a diagnostic plot using a second printhead that maps the nozzles firing ink from the first printhead, wherein a nozzle on the second printhead is disabled when printing the diagnostic plot when a corresponding nozzle on the first printhead does not fire ink.

2. The method of claim 1, wherein the method includes determining a nozzle status of the first printhead by examining the diagnostic plot printed by the second printhead.

3. The method of claim 1, wherein using a drop detector includes detecting the nozzles that fire ink in the first printhead using an electrostatic sensor.

4. The method of claim 1, wherein the method includes firing a gloss enhancer from the first printhead.

5. The method of claim 1, wherein the method includes firing low visibility ink from the first printhead.

6. The method of claim 1, wherein the method includes firing visible ink from the second printhead.

7. A printhead diagnostic plot system, comprising:

a first printhead having a number of nozzles;

a number of drop detectors to determine which nozzles in the first printhead eject ink;

a second printhead with a number of nozzles; and wherein the first printhead, the drop detectors, and the second printhead are coupled together to allow the second printhead to print a diagnostic plot with visible ink that maps the nozzles in the first printhead determined to eject ink as detected by the number of drop detectors, wherein a nozzle on the second printhead is disabled to print the diagnostic plot when a corresponding nozzle on the first printhead is not determined to eject ink.

8. The system of claim 7, wherein the system includes a visual inspection of the diagnostic plot printed with the second printhead that determines a nozzle status in the first printhead.

9. The system of claim 8, wherein the system includes a status diagnosis of the first printhead by visually identifying the nozzles that are ejecting ink as indicated by the visible ink on the diagnostic plot.

10. The system of claim 7, wherein the number of drop detectors include electrostatic sensors coupled to each nozzle in a printhead.

11. The system of claim 7, wherein the ink in the first printhead is a gloss enhancer.

12. The printhead diagnostic plot system of claim 7, wherein the ink in the first printhead is a low visibility ink.

13. A tangible computer readable medium having computer-executable instructions stored thereon for execution by a processor to perform a method, comprising:

detecting which of a number of nozzles in a first printhead fire ink; and printing with visible ink a diagnostic plot using a second printhead that maps which nozzles fire ink in the first printhead;

disabling a nozzle on the second printhead when a corresponding nozzle on the first printhead does not fire ink.

14. The medium of claim 13, wherein the method includes determining which of the number of nozzles in the first printhead fire ink by visually identifying the nozzles that fire ink in the second printhead as indicated by the placement of visible ink on the diagnostic plot.

15. The medium of claim 13, wherein the method includes enabling a nozzle on the second printhead when a corresponding nozzle on the first printhead fires ink.

16. The medium of claim 15, wherein printing the diagnostic plot using the second printhead includes only enabled nozzles.

17. The medium of claim 13, wherein the method further comprises directing nozzles in the first printhead to fire ink in a first diagnostic plot;

wherein detecting which of the number of nozzles in a first printhead fire ink comprises detecting with electrostatic sensors a first plurality of nozzles in the first printhead that fire ink; and wherein printing with the visible ink comprises printing with the visible ink the diagnostic plot using a first plurality of nozzles in the second printhead that maps to the first plurality of nozzles in the first printhead.

18. The medium of claim 13, wherein detecting which of the nozzles fire ink in the first printhead includes detecting fired ink drops with an electrostatic sensor.

19. The medium of claim 13, wherein the method includes using a gloss enhancer as the ink in the first printhead.

20. The medium of claim 13, wherein the method includes using a low visibility ink as the ink in the first printhead.

* * * * *